US011542726B2

(12) United States Patent
Moen et al.

(10) Patent No.: US 11,542,726 B2
(45) Date of Patent: Jan. 3, 2023

(54) SURFACE MOUNTED SINGLE SOLENOID ELECTRIC STRIKE

(71) Applicant: SECURITY DOOR CONTROLS, INC., Camarillo, CA (US)

(72) Inventors: David Christian Moen, Ventura, CA (US); Gilbert D. Bolanos, Jr., Simi Valley, CA (US); David Geringer, Camarillo, CA (US)

( * ) Notice: Subject to any disclaimer, the term of this patent is extended or adjusted under 35 U.S.C. 154(b) by 105 days.

(21) Appl. No.: 16/840,258

(22) Filed: Apr. 3, 2020

(65) Prior Publication Data

US 2020/0318394 A1 Oct. 8, 2020

Related U.S. Application Data

(60) Provisional application No. 62/830,285, filed on Apr. 5, 2019.

(51) Int. Cl.
*E05B 47/00* (2006.01)

(52) U.S. Cl.
CPC .. *E05B 47/0047* (2013.01); *E05B 2047/0076* (2013.01)

(58) Field of Classification Search
CPC ..... E05B 47/0002; E05B 47/0003; E05B 47/0004; E05B 47/0016; E05B 47/0046; E05B 47/0047; E05B 2047/0024; E05B 2047/0036; E05B 2047/0073; E05B 2047/0076; E05B 2047/0079; E05B 2047/0081; E05B 63/24; E05B 63/244; E05B 63/248; E05B 63/0065; Y10T 292/081; Y10T 292/0848; Y10T 292/0852; Y10T 292/0854; Y10T 292/0814; Y10T 292/0818; Y10T 292/0876; Y10T 292/0883; Y10T 292/68; Y10T 292/696; Y10T 292/699; Y10T 292/702

See application file for complete search history.

(56) References Cited

U.S. PATENT DOCUMENTS 7,021,684 B2 * 4/2006 Orbeta ..... E05B 47/0046 292/201
8,047,585 B1 * 11/2011 Peabody ..... E05B 47/0046 292/341.15

(Continued)

*Primary Examiner* — Kristina R Fulton
*Assistant Examiner* — Noah Horowitz

(57) ABSTRACT

Surface mount electric strikes according having a housing with an opening for a door latch bolt. First and second opposing latches are movably mounted to the housing and operable to open or block the lack bolt opening. First and second keepers can be in the housing each of which is arranged to cooperate with a respective one of the first and second opposing latches to block or not movement of its latch. A single actuating device is also in the housing and is controlled by an electrical signal. It is arranged to operate on the first and second keepers and is moveable in the housing between two positions. One or more mode control screws can be included that engages the actuating device through the housing and are movable between at least two screw positions. The movement of the screw causing movement of the actuating device between its device positions, wherein one of the positions results in operation of the strike in fail-safe mode, and the other of the positions results in operation of the strike in fail-secure mode.

19 Claims, 5 Drawing Sheets

(56) References Cited

U.S. PATENT DOCUMENTS

| | | | | |
|---|---|---|---|---|
| 8,096,594 | B2 * | 1/2012 | Uyeda | E05B 47/0046 292/341.15 |
| 8,454,063 | B2 * | 6/2013 | David | E05B 47/0046 292/341.15 |
| 9,617,755 | B2 * | 4/2017 | Peabody | E05B 47/0046 |
| 9,702,167 | B2 * | 7/2017 | Liao | E05B 47/0046 |
| 10,988,959 | B1 * | 4/2021 | Martin | E05B 47/0046 |
| 11,180,931 | B2 * | 11/2021 | Chang | E05B 47/0047 |
| 11,408,204 | B2 * | 8/2022 | Peabody | E05B 15/0205 |
| 2018/0044945 | A1 * | 2/2018 | Geringer | E05B 65/1093 |
| 2019/0017301 | A1 * | 1/2019 | Gumbo | E05B 81/72 |
| 2021/0062548 | A1 * | 3/2021 | Singh | E05B 47/0002 |

* cited by examiner

ENERGIZED

DE-ENERGIZED

ENERGIZED

DE-ENERGIZED

FAIL SECURE
FAIL SAFE
DEAD LATCH IN UNLOCKED POSITION
DEAD LATCH IN LOCKED POSITION
DEAD LATCH IN UNLOCKED POSITION
10
10
10
10

SURFACE MOUNTED SINGLE SOLENOID ELECTRIC STRIKE

This application claims the benefit of U.S. Provisional Patent Application Ser. No. 62/830,285, filed on Apr. 5, 3019.

BACKGROUND OF THE INVENTION

Field of the Invention

This invention relates to strikes for doors, and in particular to a surface mounted electric strike operable in fail-safe and fail-secure modes.

Description of the Related Art

Door locking mechanisms and security doors to prevent theft or vandalism have evolved over the years from simple doors with heavy duty locks to more sophisticated egress and access control devices. Hardware and systems for limiting and controlling egress and access through doors are generally utilized for theft-prevention or to establish a secured area into which (or from which) entry is limited. For example, retail stores use such secured doors in certain departments (such as, for example, the automotive department) which may not always be manned to prevent thieves from escaping through the door with valuable merchandise. In addition, industrial companies also use such secured exit doors to prevent pilferage of valuable equipment and merchandise.

Electric strikes are a class of door mechanisms that have been developed to control access to buildings or areas. For some, an actuator (e.g. an electrically driven motor or solenoid) is used to move a blocking element to block or release a keeper to either prevent or allow release of a door's latch bolt. This keeps the door latched and in the locked position or allows the door to be opened.

Typically, electric strikes have two modes, namely a "fail-secure" mode (where the door is locked with the power removed, i.e. the actuation means must be triggered to allow the door to be opened), and a "fail-safe" mode (where the door is unlocked with the power removed, i.e. the actuation means must be triggered to prevent the door from being opened). Some strikes on the market have only one-mode capability, while others are dual mode allowing the installer to select which mode is desired at the time of installation.

Dual mode surface mount electric strikes are disclosed in U.S. Pat. Nos. 7,021,684 and 8,454,063. These electrical strikes, however, are relatively complex. For example, the strike in U.S. Pat. No. 7,021,684 relies on a solenoid and cam system of control blocking of two latches in the strike by blocking both latches, but this system tends to bind and fails to open particularly under pre-load. The strike in U.S. Pat. No. 8,454,063 utilizes two solenoids with two multiple element mechanisms and related features to control blocking of two latches and comprises a complex operation. Both these patents require removal of the strike's primary cover and manipulation of the strikes internal components to change between fail-safe and fail-secure modes.

Shear strength or shear force refers to the force needed to overcome the holding force of the blocking elements when the strike is in the lock mode. Stated differently, this is the force needed to force the door open against the holding force of the strike. Some conventional electrical strikes have limited shear strength, which can make them susceptible to being forced open when the door is intended to remain locked.

SUMMARY OF THE INVENTION

The present invention comprises an improved surface mount electric strike to provide simple, efficient, reliable and robust operation. The strike also provides for increased shear force holding, which allows for the strike to more securely hold the door locked when desired.

The strike comprises a simplified design that relies on one solenoid and is changeable between fail-safe and fail-secure modes by changing the location of mode screws without removal of the primary cover. This results in easier changing of the mode at the factory or in the field during installation. The dual mode device does away with need to stock both fail-safe and fail-secure devices. The present invention also provides for reliable and robust operation, even under pre-load.

One embodiment of a surface mount electric strike according to the present invention comprises a housing having an opening for a door latch bolt. First and second opposing latches are movably mounted to the housing and operable to open or block the lack bolt of opening. First and second keepers be in the housing each of which is arranged to cooperate with a respective one of the first and second opposing latches to block or not block movement of its latch. A single actuating device is also in the housing and is controlled by an electrical signal. It is arranged to operate on the first and second keepers and is moveable in the housing between two positions. A mode control screw can be included that engages the actuating device through the housing and is movable between at least two screw positions. The movement of the screw causing movement of the actuating device between its device positions, wherein one of the positions results in operation of the strike in fail-safe mode, and the other of the positions results in operation of the strike in fail-secure mode.

The present invention can also be used in door systems that can comprise a door jamb with a door rotatably mounted to said door jamb and a door opening/locking mechanism mounted to the door jamb and comprises a latch bolt. The door systems can comprise different embodiments of a surface mount electric strike according to the present invention that can be mounted to the door jamb to engage the latch bold of the door opening/locking mechanism.

The strikes according to the present invention can comprise many different features as described below. These and other aspects and advantages of the invention will become apparent from the following detailed description and the accompanying drawings which illustrate by way of example the features of the invention.

DETAILED DESCRIPTION OF THE INVENTION

Figure 1:
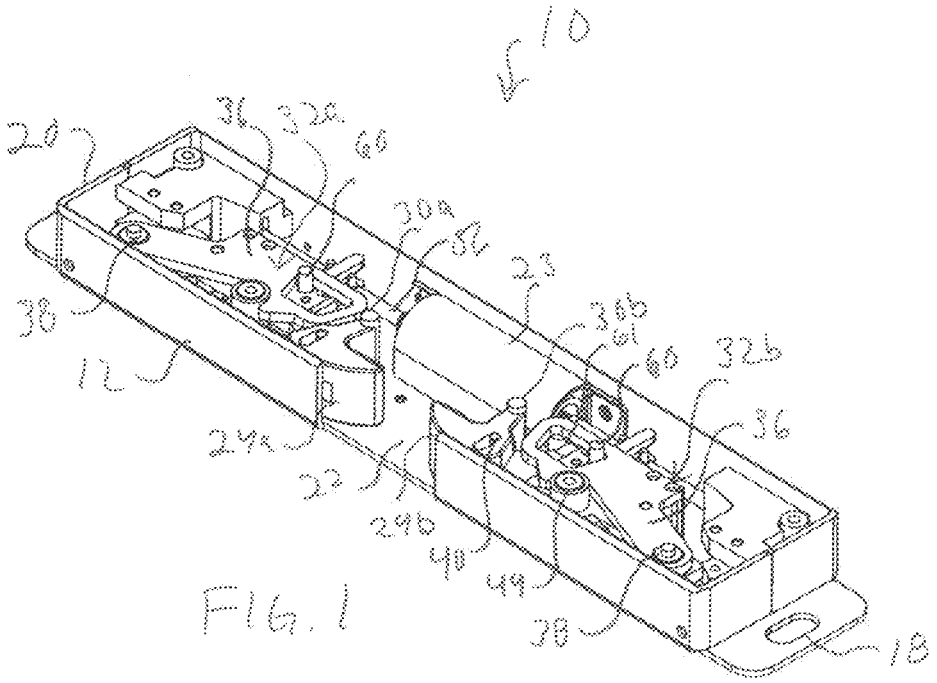
FIG. 1 is a front perspective view of one embodiment of a surface electrical strike according to the present invention.
Figure 2:
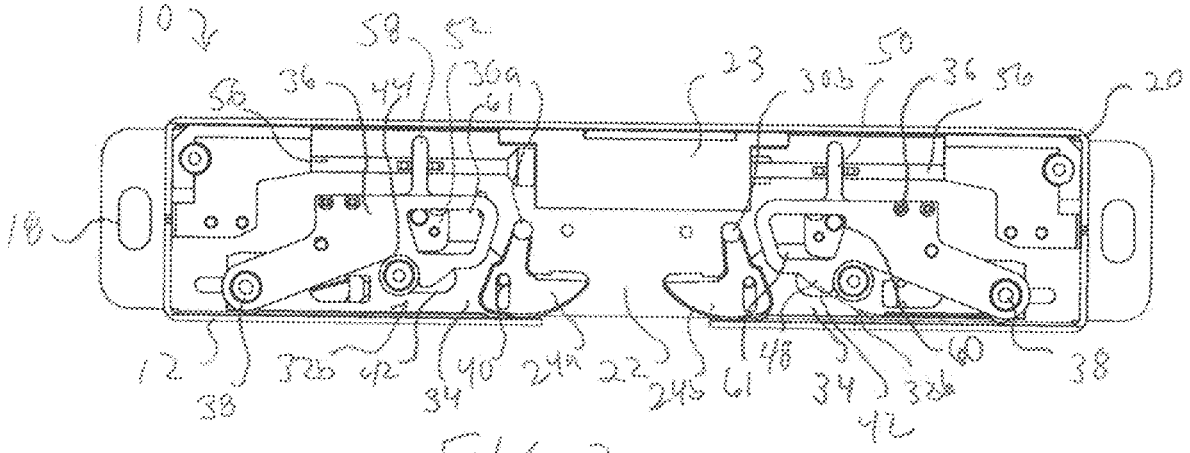
FIG. 2 is a plan view of the electric strike in FIG. 1.

The present invention provides an improved dual mode surface mount electric strike that can be changed in the field to be operable in both the fail-safe and fail-secure modes. The strikes according to the present invention can comprise fewer parts that efficiently work with the action of a single solenoid to operate in both of the dual modes. By having fewer parts, the strikes according to the present invention can be cheaper, easier to operate and can be more reliable. In the event of a failure, the simplified design can also make the strikes easier to repair.

The strikes according to the present invention can also be easily changed between fail-safe and fail-secure modes in the field, without removing a cover to access the internal components of the strike. In some embodiments, the mode can be changed by a single screw that can be moved between two positions or can comprise multiple screws moved between two positions. The present invention is also arranged so that it can more efficiently change between lock or unlock modes and is arranged so that it is less likely to jam, even when there is a pre-load from the door on the latch of the strike. This results in more reliable opening of the door when desired.

The present invention is described herein with reference to certain embodiments, but it is understood that the invention can be embodied in many different forms and should not be construed as limited to the embodiments set forth herein. In particular, many of the internal components of the electric strikes according to the present invention can be arranged in many different ways and different embodiments can comprise different internal components. The fail-safe/fail-secure mode selector can be arranged in many different ways beyond the embodiments described herein. The strikes according to the present invention can use different elements, can have different pre-load features, and can have different switches in different locations.

It is also understood that when an element or component is referred to as being "on", "connected to" or "coupled to" another element, it can be directly on, connected to or coupled to the other element or intervening elements may also be present. Furthermore, relative terms such as "front", "back", "inner", "outer", "upper", "above", "lower", "beneath", and "below", and similar terms, may be used herein to describe a relationship of one component or element to another. It is understood, however, that these terms are intended to encompass different orientations of the device in addition to the orientation depicted in the figures.

Although the terms first, second, etc. may be used herein to describe various elements or components, these elements and components should not be limited by these terms. These terms are only used to distinguish one element or component from another element or component. Thus, a first element or component discussed below could be termed a second element or component without departing from the teachings of the present invention. Similarly, the present invention may be described with reference to single or multiple elements, but it is understood that other embodiments can comprise more elements than those described herein. For example, embodiments of the present invention are described with reference to a single solenoid, but it is understood that other embodiments can have more than one solenoid.

Embodiments of the invention are described herein with reference to certain illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the elements or components illustrated herein but are to include deviations in shapes that result, for example, from manufacturing. Thus, the regions illustrated in the figures are schematic in nature and their shapes are not intended to illustrate the precise shape of an element or component and are not intended to limit the scope of the invention.

Figure 3:
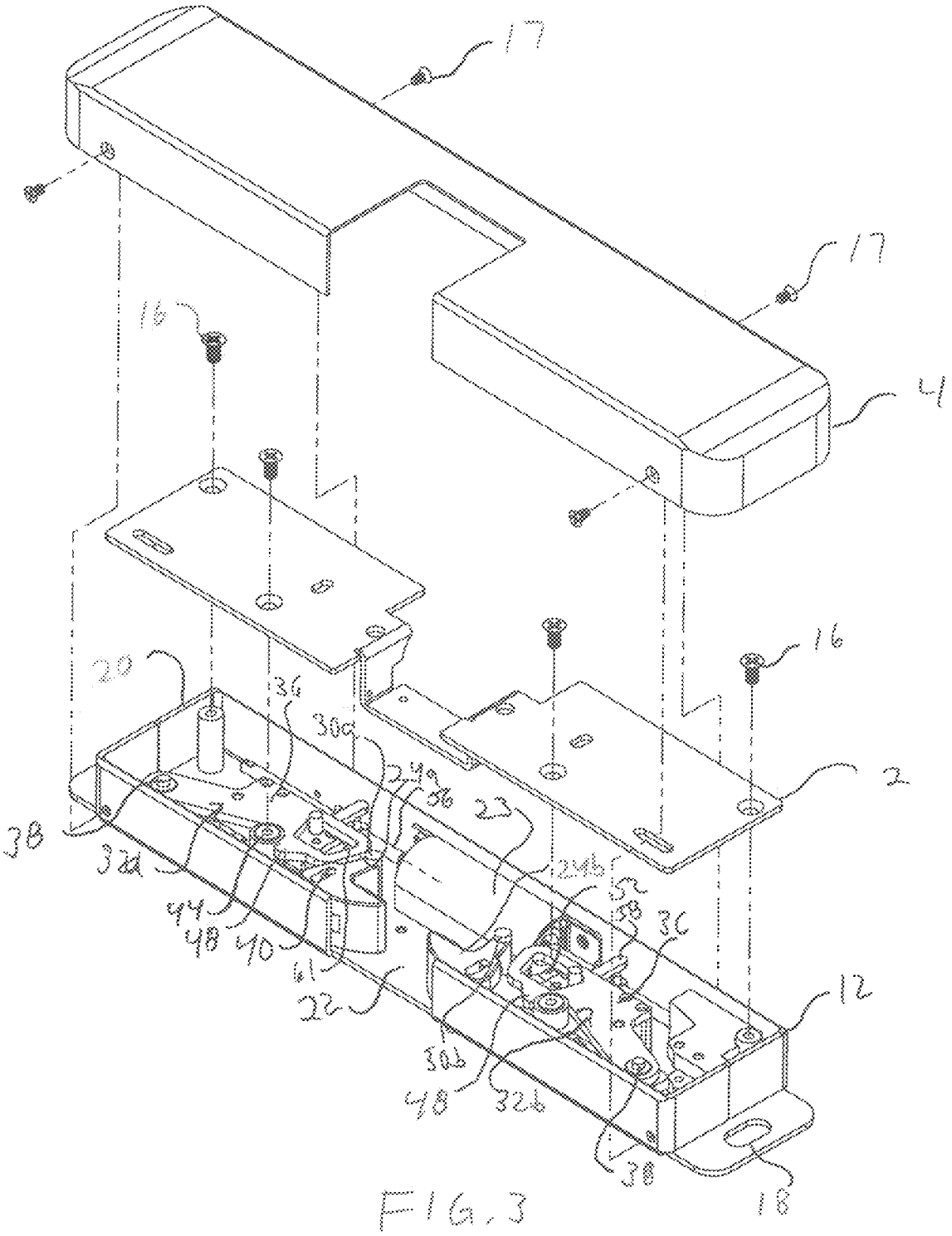
FIG. 3 is a partial front exploded view of the electric strike shown in FIG. 1.
Figure 4:
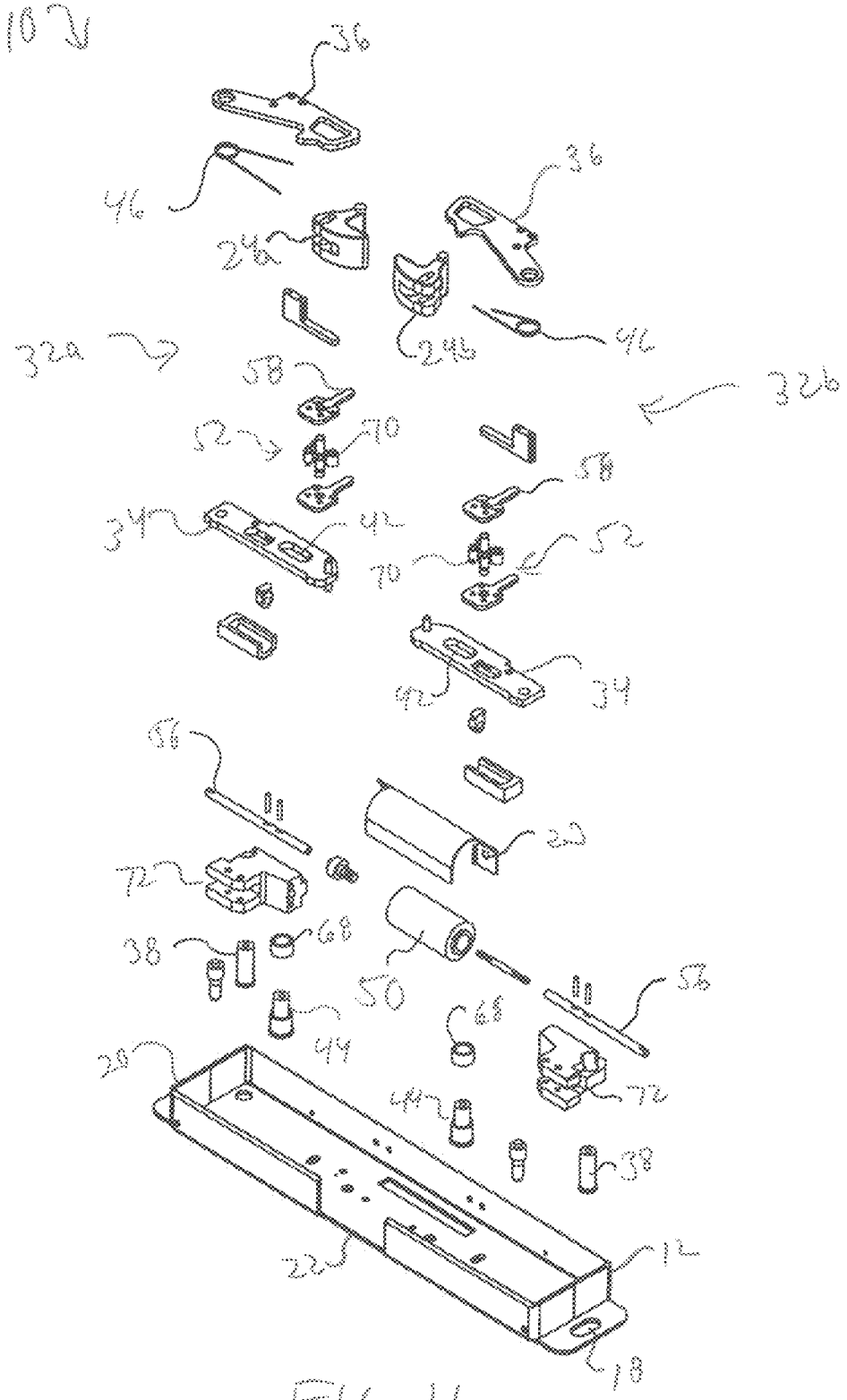
FIG. 4 is a further exploded view of the electric strike shown in FIG. 1.

FIGS. 1-8 show one embodiment of a surface mount electric strike 10 according to the present invention comprising. FIG. 3 shows a primary cover 2 and a secondary cover 4 that can be used with the strike 10, with all FIGS. 1-8 showing the strike's internal components. The strike 10 comprises a housing 12 holding the strike's internal components. Primary cover 2 is mounted to the housing 12 to cover the strike's internal components, and the primary cover 2 can be removed from the housing 12 by removing housing screws 16. The secondary cover 4 can then be mounted over the housing 12 and is mounted in place by secondary screws 17. The secondary cover 4 covers the housing to give the strike 10 the desired aesthetic appearance when finally installed.

The strike 10 further comprises mounting holes 18 for mounting screws to pass for surface mounting the strike to the door jamb. The mounting holes 18 can be oval shaped to allow for adjustment of the location of the strike on the door jamb. It is understood that this is only one of the many different mounting methods that can be used in different embodiments according to the present invention.

The housing 12 has a generally rectangular footprint, with a major axis A being along its larger length and its minor axis B being along its shorter width. The housing 12 has a peripheral wall 20 that surrounds the base of the housing 12 to form a space for the strike's internal components. The peripheral wall 20 also comprises a bolt opening 22 formed along the minor axis B for housing a door latch bolt when the strike 10 is in use. In regular operation, the latch bolt can be removed from the opening 23, and the door opened by retracting the bolt by turning the door handle or pushing a push-bar, depending on the type of door and locking mechanism. As described in more detail below, a door can be mounted in the same door jamb or frame as the strike 10, and when the door is closed the door's latch bolt can be arranged in the opening 22.

The strike 10 further comprises opposing latches **24*a*, 24*b* that close access to the opening 22 along an edge of the strike, and during operation the bolt can be arranged in the opening 22. As further described below, the latches 24*a*, 24*b* can be pivotally mounted such that under certain conditions they can rotate out to open the opening 22 for the bolt to be removed from the opening 22 along the edge of the strike 10 to open the door. This allows for the door to open without having to retract the bolt from the opening 22**, which allows for the door to open in conditions when the door may be locked such that the bolt cannot be retracted.

Figure 9:
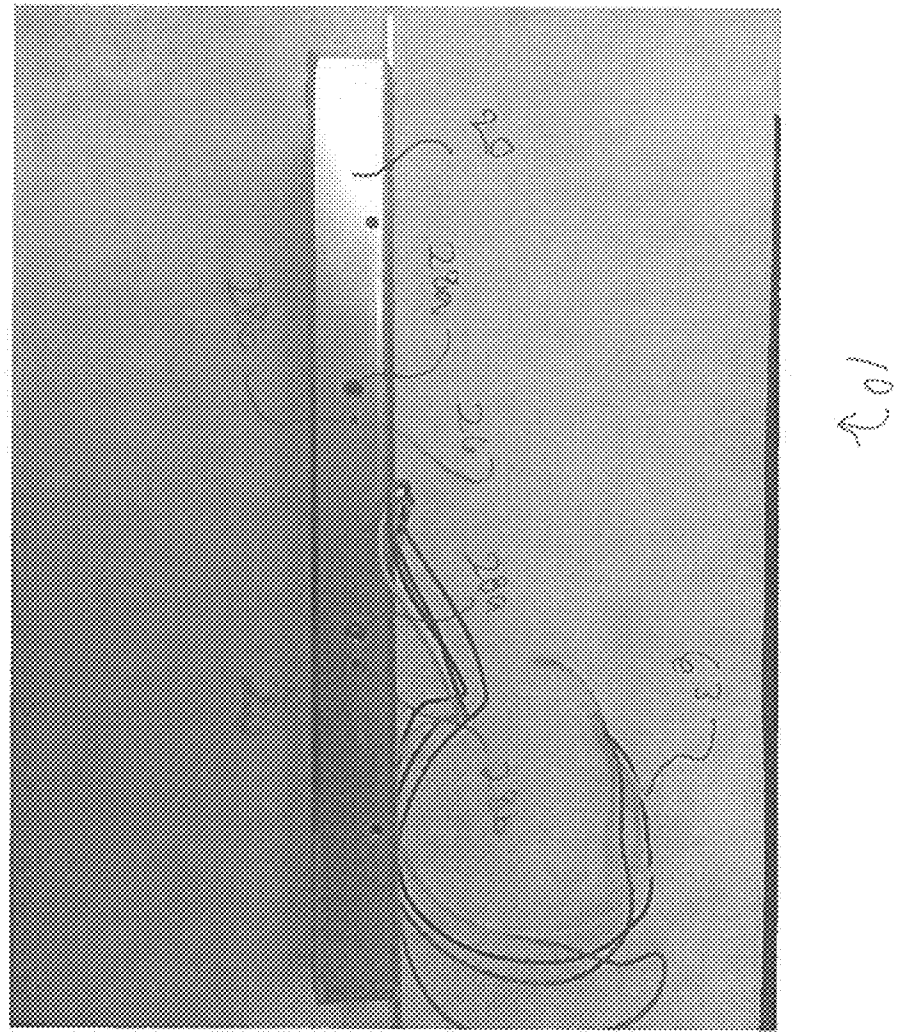
FIG. 9 is a side view of one embodiment of electric strike according to the present invention.

The strike according to the present invention can be arranged in different ways to operate in both fail-safe and fail-secure modes. To change modes, the secondary cover 4 is removed from the housing 10 (shown in FIG. 4). As best shown in FIG. 9, two mode select screws 26 can be included that pass through the peripheral wall 20 opposite the opening 22, with the screws engaging a solenoid housing 23 (best shown in FIGS. 1-4). The solenoid housing 23 holds a solenoid 50 (described below). The mode screws 26 can be located in two different positions to provide for fail-safe or fail-secure operation depending on which of the two locations is selected. In one of the fail-safe and fail-secure modes, the mode screws 26 can be in one of the first and second mode holes 28*a*, 28*b* in the peripheral wall 20 for the different modes. To change modes, the screws 26 can be removed from their one of the holes 28*a*, 28*b*, the solenoid housing (and the solenoid) can be moved to the other position, and then the screws 26 placed in the other of the holes 28*a*, 28*b* to engage the solenoid housing 23.

In other embodiments, the two mode locations can comprise tapered holes connected by a slot. The mode screw 26 can be loosened but not fully removed, and the screw can slide in the slot to the other mode location. The screw 26 can then be tightened. This can allow for changing of the modes between fail-safe and fail-secure without having to access the internal components of the strike in the housing 10. The mode screws 26 can be loosened, but not removed from the solenoid housing 23. The screws should be loosened enough to allow the screw head to clear the tapered holes, but still engage the solenoid housing 23. This allows for the screws 26 to be moved along the connecting slot (which is wide enough to accommodate the screw) between the tapered holes, while at the same time moving the solenoid housing 23 with the movement of the screws 26. The movement of the screws 26 between the tapered holes allows for changing of the strike operation between fail-safe and fail-secure modes.

It is understood that the mode select screws can be arranged in many different ways and different embodiments can have different numbers of screws. In some embodiments, other mode changing mechanisms can be used including but not limited to, latches, pushbuttons, etc. In still other embodiments, one mode changing screw can be used, or three or more mode changing screws can be used.

Referring again to FIGS. 1-8, first and second opposing latches 24*a*, 24*b* are mounted to housing 12 on a respective one of first and second posts 30*a*, 30*b* with each of the latches 24*a*, 24*b* able to rotate about its respective one of the first and second posts 30*a*, 30*b* during operation. The strike 10 also comprises first and second locking assemblies 32*a*, 32*b* arranged to operate with a respective one of the latches 24*a*, 24*b* to allow the latches 24*a*, 24*b*, to be held in the position wherein they block the opening 22, or to allow the latches 24*a*, 24*b*, to rotate about their respective post 30*a*, 30*b* to allow the latches 24*a*, 24*b* to allow opening of the opening 22.

Each of the locking assemblies 32*a*, 32*b* comprises a slide 34 and a keeper 36 with the slide 34 connected to its respective one of the latches 24*a*, 24*b* by a slide pin 40. The keeper 36 is rotatably mounted to the slide 34 at keeper pin 38. The keeper 36 moves between up and down positions as described below to allow the strike to change between locked and unlocked. The slide 34 comprises a slide slot 42 arranged on a slide post 44 allowing the slide 34 to move longitudinally along the A axis during operation. As each latch 24*a*, 24*b* moves to the open position it moves its slide 34 away from the opening 22 while moving the slot 42 on its slide post 44.

Figures 5, 6, 7, 8:
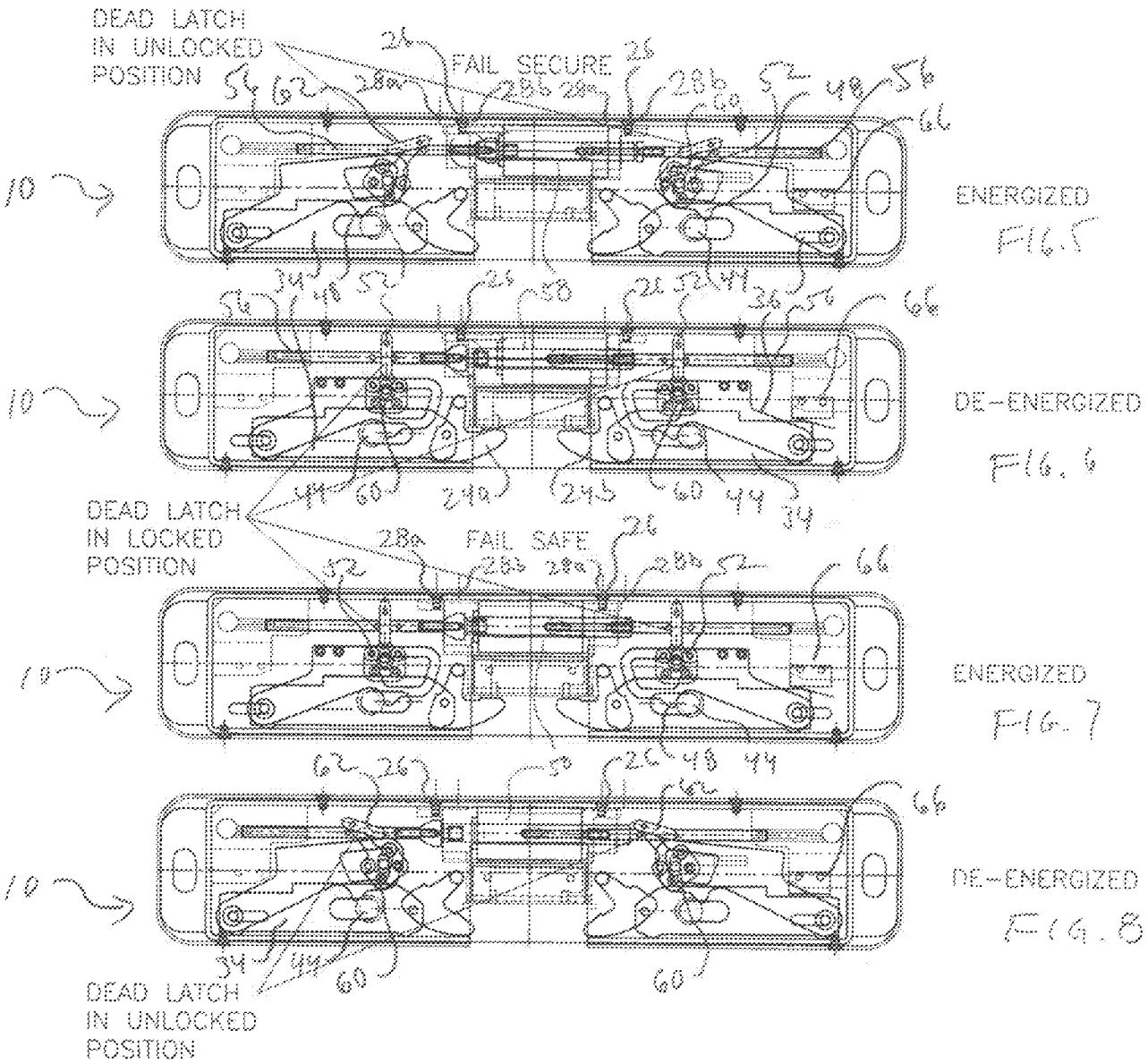
FIG. 5 is a plan view of the electric strike shown in FIG. 1, with the cover removed and in fail secure mode.
FIG. 6 is another plan view of the electric strike shown in FIG. 1, with the cover removed and in fail secure mode.
FIG. 7 is a plan view of the electric strike shown in FIG. 1, with the cover removed and in fail safe mode.
FIG. 8 is another plan view of the electric shown in FIG. 1, with the cover removed and in fail safe mode.

Each locking assembly 32*a*, 32*b* further comprises a keeper spring 46 (shown in FIG. 4) arranged to urge the keeper 36 to the down position. The keeper 36 comprises a locking tooth 48 and as best shown in FIGS. 1-3, 6 and 7. The locking tooth 48 cooperates with the slide post 44 to prevent the slide from sliding. The locking tooth 48 overlaps the slide post 44, preventing the slide post 44 from moving in its slot 42. As shown in FIGS. 5 and 8, when the cam 36 is in the up position, the tooth 48 disengages from the post 44 to allow the post 44 to move in the slot 42 as the latches 24*a*, 24*b* move to the open position.

The strike 10 also comprises a single solenoid 50 and each of the locking assemblies 32*a*, 32*b* also comprise an activation lever 52 that is rotatably mounted to the base of the housing 12 by a lever post 54. Each keeper 36 partially overlaps and cooperates with a respective activation lever 52 with each activation lever having an activation post 60 in a keeper opening 61, such that rotational movement of the activation lever 52 causes movement of its respective keeper 36.

The solenoid 50 comprises a plunger 56 that is movable between two positions when the solenoid corresponding to when the solenoid is energized and when it is not energized. The elements and operation of solenoids are generally known in the art and is not discussed in detail herein. The plunger 56 can be mounted within the solenoid 50 and the solenoid 50 can comprise a coil (not shown) around at least a portion of the plunger. An electrical signal applied to the solenoid 50 through conductors 63 (shown in FIG. 9) is transmitted to the coil, which creates an electrical field that either causes the plunger 56 to extend from or retract into the solenoid as is understood in the art. In some embodiments, the plunger 56 can have a bias spring that can be arranged to bias the plunger in either the retracted position or the extended position when the solenoid is not energized.

In the embodiment shown, the plunger 56 extends from both ends for the solenoid 50 and is movable from both ends during operation of the solenoid 50. Each activation lever 52 comprises a finger 58, each of which is attached to the plunger 56 on opposing sides of the solenoid 50 such that each activation lever 52 rotates about its post 54 with movement of the plunger 56.

As best shown in FIGS. 6 and 7, when each activation lever 52 is positioned along the B axis, its keeper post 60 is positioned such that its respective keeper 36 is free to move to the down position in response to urging from its keeper spring 46. This causes the keeper's locking tooth 48 to overlap its post 44 to hold the slide from sliding. Referring now to FIGS. 5 and 8, when the activation lever 52 is at an angle to the B axis its corresponding keeper post 60 moves its keeper 36 to the up position against the urging of its cam spring 46. This disengages the tooth 48 from its slide post 44, allowing the post 44 to slide in its slot 42. This allows the slide 34 to slide with movement of its latch. The action of the plunger 56 with energizing and de-energizing of the solenoid causes movement of both locks between aligned (with the B axis) and angled, as described in more detail below.

Each lock also comprises a locking link 62 (best shown in FIGS. 5-8) that connects the lever finger 58 to the plunger 56, with each link 62 arranged to provide additional holding or shear force when the keeper 36 is in the locked position. As shown in FIGS. 6 and 7, when the activation levers 52 is in the aligned position, the end of the link 62 abuts against the inner surface of the peripheral wall 20 to hold the keeper 36 in the down and locked position, and to help prevent excessive force on the latches from overcoming the holding force of the tooth 48 on its post 44.

The strikes according to the present invention can also include sensors or switches 66 in various locations to monitor the state or location of different components. These can include commercially available sensors or switches that, for example, can monitor the location of the latches 24*a*, 24*b* to determine if they have been pivoted out. Sensors can also be included to monitor for the location of the solenoid plunger 56, the slides 34, the keepers 36, or the activation levers 52.

As mentioned above, the strikes according to the present invention can be arranged to work in different modes, such as in the fail-safe and fail-secure modes, by changing the position/orientation of one or more of its internal components. In the embodiment shown and as further described below, the strike 10 can be arranged in the different modes by changing the position/orientation location of the solenoid 50, which in turn changes the position of the plunger 56. This in turn changed the orientation of each activation lever 52 from an aligned position to an angled position. The position of the solenoid can be changed by changing the mode screw 26 in the first and second mode holes 28*a*, 28*b* as described above.

FIGS. 5 and 6 show operation of the strike 10 in the fail-secure mode with mode screws 26 in second mode hole 28*b*. As shown in FIG. 5, when the solenoid 50 is energized, the plunger 56 is in position such that the activation levers 52 are angled to the right. This position results in the keeper post 60 from each activation lever 52 moving its keeper 36 away from its slider 34 such that each keeper tooth 48 is disengaged from its post 44. This positioning allows the slide 34 to slide with the opening action if its one of the latches 24*a*, 24*b*. Referring now to FIG. 6, when the solenoid 50 is de-energized the plunger 56 moves such that each activation lever 52 is in the aligned position. This allows each keeper spring 46 (shown in FIG. 4) to move its keeper 36 to the down position such that each tooth 48 engages its slide post 44 to prevent the slide 34 from sliding. This in turn prevents each latch 24*a*, 24*b* from rotating to the open position. If power is lost to the strike 10, the solenoid 50 will become de-energized and the latches will be prevented from moving to the open position. This corresponds to fail-secure operation.

FIGS. 7 and 8 show operation of the strike 10 and fail-safe mode with the mode screw 26 in first mode hole 28*a*, with causes the solenoid 50 to be positioned to the left of its fail-secure position described above. As shown in FIG. 7, when the solenoid 50 is energized, the activation levers 52 are in the aligned position, thereby preventing the latches 24*a*, 24*b* from moving to the open position as described above. As shown in FIG. 8, when the solenoid is de-energized, each activation lever 52 is moved to the angled position, which allows the latches to move to the open position as described above. If power is lost to the strike 10, the solenoid 50 will become de-energized and latches 24*a*, 24*b* will be free to move to the open position. This corresponds to the fail-safe mode.

As mentioned above, strikes according to the present invention can provide the additional advantage of reliable opening, even under pre-load on the latches. One pre-load can be caused by pressure from the bolt being exerted on the latches 24*a*, 24*b* when the strike is attempting to change between locked and unlocked. The strikes according to the present invention comprise features to prevent binding of the strike components under pre-load. For example, each of the slide posts 44 can have a sleeve 68 that freely rotates about its post. This allows for each tooth 48 to freely disengage from its post 44 even under pre-load. The activation lever 52 can also have rollers 70 that allow for easy and reliable movement of the activation levers 52 between the aligned and angled positions. Bushing 72 can also be arranged at each end of the plunger 56 to allow for smooth and reliable movement of the plunger 56. The bushings 72 can be made of many different materials, with some embodiments being made of a plastic, such as commercially available Delron plastic. The strikes according to the present invention can be arranged to reliably operate under a pre-load up to 30 pounds or more, with some embodiments reliably operating with a pre-load of up to 15 pounds.

The present invention provides an improved and simplified dual-mode surface mount strike. The strike can operate with fewer different pieces, which can reduce the cost and complexity of the strike and can reduce the number of pieces that might fail. The strikes according to the present invention provide a unique mechanism that transfers the lateral motion of plunger 56 into up and down orthogonal motion of the keepers 36. This orthogonal motion allows for a simplified arrangement for blocking the latches 24*a*, 24*b* from opening when desired.

It is understood that many different mechanisms and arrangements can be used to translate this motion in strikes according to the present invention. Some of these include, but are not limited to, cams, gears, pulleys, etc., and the mechanisms can comprise any combination of the devices described herein. It is also understood that that strikes according to the present invention can have many different elements arranged in different ways. Although the present invention has been described in detail with reference to certain preferred configurations thereof, other versions are possible. Therefore, the spirit and scope of the invention should not be limited to the versions described above.

We claim:

1. A surface mount electric strike, comprising:

a housing having an opening for a door latch bolt; first and second opposing latches movably mounted to said housing and operable to open or block said latch bolt opening;

first and second keepers in said housing each of which is arranged to cooperate with a respective one of said first and second opposing latches to block or not block movement of its latch;

a single solenoid in said housing controlled by an electrical signal and comprising a plunger comprising first and second portions, each of which extends from opposite sides of solenoid, wherein each of said portions is arranged to operate on a respective one of said first and second keepers, said single solenoid arranged internal to said housing and moveable between two positions;

a mode control screw engaging said actuating device through said housing and movable between at least two screw positions, the movement of said screw and said solenoid between said device positions results in operation of said strike in fail-safe mode, and the other of said positions results in operation of said strike in fail-secure mode.

2. The electric strike of claim 1, wherein said mode control screw does not have to be completely removed to allow movement of said actuating device between said device positions.

3. The electric strike of claim 1, wherein said mode control two screw positions comprise tapered screw holes joined by a slot.

4. The electric strike of claim 1, wherein said first and second keepers are rotatably mounted within said housing.

5. The electric strike of claim 4, wherein each of said first and second keepers is mounted to said housing by a keeper pin.

6. The electric strike of claim 1, further comprising first and second keeper posts each said first and second keepers comprises a keeper locking tooth that engages one of said keeper posts to blocks its one of said first and second latches.

7. The electrical strike of claim 1, further comprising first and second locking links that abut the inner surface of said housing to block movement of said first and second latches.

8. The electric strike of claim 1, further comprising bushings to provide reliable operation of said actuator under pre-load.

9. The electrical strike of claim 6, further comprising first and second sleeves each of which is on a respective one of said first and second keeper posts.

10. A door system, comprising a door jamb with a door rotatably mounted to said door jamb;

a door opening/locking mechanism mounted to said door jamb and comprising a latch bolt;

a surface mount electric strike mounted to said door jamb to engage said door opening/locking mechanism, comprising:

a strike housing having an opening for a latch bolt;

first and second opposing latches movably mounted to said housing and operable to open or block said lack bolt opening;

first and second keepers in said housing each of which is arranged to cooperate with a respective one of said first and second opposing latches to block or not movement of its latch;

a single actuating device in said housing movable between two actuator positions and controlled by an electrical signal and comprising first and second actuators extending from opposite surfaces of said actuating device, with each of said actuators movable by said actuating device and each of said actuators arranged to operate on a respective one of said first and second keepers, said single actuating device arranged internal to said housing and moveable between two positions; and mode control screws engaging said actuating device through said housing and each movable between at least two screw positions, the movement of said screws between said screw positions and movement of said actuator between said actuator positions, changing operation of said electrical strike between two modes.

11. The door system of claim 10, wherein said two modes comprises a fail-safe mode, and a fail-secure mode.

12. The door system of claim 10, wherein said mode control screws do not have to be completely removed to allow movement of said actuating device between said device positions.

13. The door system of claim 10, wherein said two mode control screw positions comprise tapered screw holes joined by a slot.

14. The door system of claim 10, wherein said actuating device comprises a solenoid.

15. The door system of claim 10, wherein said first and second keepers are rotatably mounted within said housing.

16. The door system of claim 15, wherein each of said first and second keepers is mounted to said housing by a keeper pin.

17. The door system of claim 10, further comprising first and second keeper posts each said first and second keepers comprises a keeper locking tooth that engages one of said keeper posts to blocks its one of said first and second latches.

18. The door system of claim 10, further comprising first and second locking links that abut the inner surface of said housing to block movement of said first and second latches.

19. The door system of claim 10, further comprising bushings to provide reliable operation of said actuator under pre-load.

* * * * *